US007562881B2

(12) United States Patent
Crowder

(10) Patent No.: US 7,562,881 B2
(45) Date of Patent: Jul. 21, 2009

(54) ADJUSTABLE HOCKEY SKATE CUFF AND LACING SYSTEM

(76) Inventor: Troy Stacey Crowder, 103 Northshore Road, Whitefish, Ontario (CA) P0M 3E0

( * ) Notice: Subject to any disclaimer, the term of this patent is extended or adjusted under 35 U.S.C. 154(b) by 289 days.

(21) Appl. No.: 11/364,335

(22) Filed: Mar. 1, 2006

(65) Prior Publication Data

US 2006/0145434 A1 Jul. 6, 2006

Related U.S. Application Data

(63) Continuation-in-part of application No. 10/648,228, filed on Aug. 27, 2003, now abandoned.

(30) Foreign Application Priority Data

Aug. 27, 2002 (CA) ..... 2399880

(51) Int. Cl.
*A63C 1/00* (2006.01)

(52) U.S. Cl. ..... 280/11.12; 280/841; 36/115

(58) Field of Classification Search ..... 36/114, 36/115, 119.1; 280/11.12, 11.221, 11.231, 280/809, 811, 841
See application file for complete search history.

(56) References Cited

U.S. PATENT DOCUMENTS 2,531,763 A * 11/1950 Andre ..... 36/117.8
2,789,374 A * 4/1957 Planert ..... 36/71
4,394,803 A * 7/1983 Goldstein ..... 36/51
4,776,111 A * 10/1988 Crowley ..... 36/89
4,783,911 A * 11/1988 Brown ..... 36/115
4,811,500 A * 3/1989 Maccano ..... 36/91
5,072,529 A * 12/1991 Graf ..... 36/115
5,319,869 A * 6/1994 McDonald et al. ..... 36/114
5,497,564 A * 3/1996 Allen et al. ..... 36/50.1
5,779,246 A * 7/1998 Bengtsson ..... 280/11.12
5,943,793 A * 8/1999 Clements ..... 36/89
6,079,128 A * 6/2000 Hoshizaki et al. ..... 36/89
6,212,796 B1 * 4/2001 Kubelka ..... 36/50.1
6,550,159 B1 * 4/2003 Madore ..... 36/115
2002/0041073 A1 * 4/2002 Chen ..... 280/11.26
2005/0229436 A1 * 10/2005 Bock ..... 36/115
2005/0284001 A1 * 12/2005 Hoffman et al. ..... 36/50.1

* cited by examiner

*Primary Examiner*—Christopher P Ellis
*Assistant Examiner*—Vaughn T Coolman

(57) ABSTRACT

A hockey skate includes a system for adjusting the position of a blade holder on the sole of a hockey skate. The system allows for both toe in and toe out adjustment as well as movement relative to the centerline. The system allows a player to try various positions and determine which positions produce superior skating performance relative to his foot, ankle and leg alignment.

15 Claims, 13 Drawing Sheets

ADJUSTABLE HOCKEY SKATE CUFF AND LACING SYSTEM

This is a Continuation-In-Part Application of U.S. patent application Ser. No. 10/648,228 filed Aug. 27, 2003 now abandoned.

FIELD OF THE INVENTION

The present invention provides a system which allows a series of adjustments where the position of the hockey blade holder relative to a hockey skate boot and the leg position of the skater are adjustable to accommodate the physical requirements of the skater.

BACKGROUND OF THE INVENTION

Hockey skate design has been dominated by a skate boot having a molded blade holder attached thereto with the holder extending downwardly from the skate. A replaceable skate blade is received in a slot on the bottom surface of the holder. The TUUK™ blade holder, manufactured by Canstar Sports Inc., is one example of this type of system. However, similar systems are offered by Easton™, CCM™, GRAF™ and others. The molded plastic blade holder includes a front hollow pedestal portion and a rear hollow pedestal portion which extend downwardly from the sole of the boot. Each pedestal includes a securing arrangement that cooperates with the downwardly opening slot for fastening of the skate blade. The pedestals taper outwardly towards the sole of the skate boot. The blade holder is secured to the sole of the boot at a number of fixed points in the boot and fixed peripheral points in an outwardly extending flange of each pedestal. Typically the blade holder is secured by rivets which pass through circular ports in the flange of each of the pedestals or by a fastener having a diameter corresponding to the hole diameter provided in the flange. The peripheral securement of the pedestals near the periphery of the sole of the skate boot provides a required mechanical advantage in distributing the forces which are transmitted through the skate boot to the skate blade. These forces can be quite large and have a variety of different directions due to the speed and sudden changes in direction common in hockey. In addition to the high forces the skate system must endure due to the skating action, there are also forces in hockey as a result of collisions with the puck the boards and/or players or other player's equipment. Securement along the centerline of the skate blade is not sufficient.

The downward tapering of the pedestals from the sole of the boot to the skate blade helps to redirect the puck and a gap is there to give stability to each of the pedestals.

Many hockey skates are sold as a complete system with the holder and blade already attached to the hockey boot at the time of manufacture. In more expensive hockey skates, the users can select the particular hockey skate boot and then match it with a desired holder and blade. Hockey skate holders are typically secured to the skate boot in a centered and aligned orientation. Forward and rearward balance on the skates can be controlled by custom blade sharpening to changing the shape of the lower surface of the blade which contacts the ice. Some players prefer a highly curved surface which is desirable for rapid turning whereas others are more interested in speed and balance and have a large flat portion between a front curved portion and a rear curved portion.

This type of adjustment has been found by the inventor to be inadequate and does not address the widely ranging physical attributes of different hockey players. As can be appreciated hockey players can be pigeon toed, duck footed, knock kneed or bowlegged. Some of these conditions are caused or exaggerated by having flat feet or fallen arches.

The inventor has been able to significantly increase performance by providing a system that allows the individual hockey player to tailor the particular securement of the blade system to a hockey boot to meet his particular needs. These adjustments can include offsets either side of a centerline of the hockey skate and it can also include toe in or toe out adjustments as well heel in and heel out adjustments. Some approximate adjustments of the position of the blade holder can be carried out in a pro-shop however, final adjustment typically requires the actual use by the player. In addition, the system allows shimming of the holder for adjustment of the leg and foot position to compensate for physical characteristics of the user that affect alignment and/or balance.

SUMMARY OF THE PRESENT INVENTION

A hockey skate according to the present invention comprises a boot, a blade holder, a blade received in the blade holder and an adjustable arrangement for altering the attachment position of the blade holder to the boot. The adjustable arrangement engages outwardly extending flanges of the boot holder in one of a plurality of positions where each of these positions has a different orientation of the blade relative to a centerline of the boot. The blade holder and boot includes a slot adjustment that has a series of securement points on opposite sides of the centerline of the blade to secure the blade holder to the boot adjacent a peripheral edge of the skate boot.

According to an aspect of the invention the adjustable arrangement includes a series of releasable fasteners passing through slot shaped ports in the blade holder and releasably engage the boot to secure the holder to the boot.

In yet a further aspect of the invention the flanges of the skate holder include a toe flange having a plurality of elongate slots in a peripheral edge portion of the toe flange to accommodate a series of toe in and toe out positions of the skate blade.

In yet a further aspect of the invention the flanges of the blade holder include a heel flange having a plurality of elongate slots in a peripheral edge portion of the heel flange to accommodate a series of heel in and heel out positions.

In yet a further aspect of the invention each of the flanges of the blade holder has at least four elongated slots with at least two pairs of slots on opposite sides of the centerline and with each pair of slots positioned closer to a peripheral edge of a bottom surface of said boot than carline of said boot.

In yet a further aspect of the invention the adjustable arrangement includes a clamping system for each flange to engage the blade holder in any of said positions.

In yet a further aspect of the invention each clamping arrangement includes a first component secured to the holder with the first component adjustably received in a second component secured to said boot.

In yet a further aspect of the invention the first component is a plate received in a slot of the second component along an edge portion of the first component and to the exterior of the blade holder and accessible on a lower portion of the boot.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
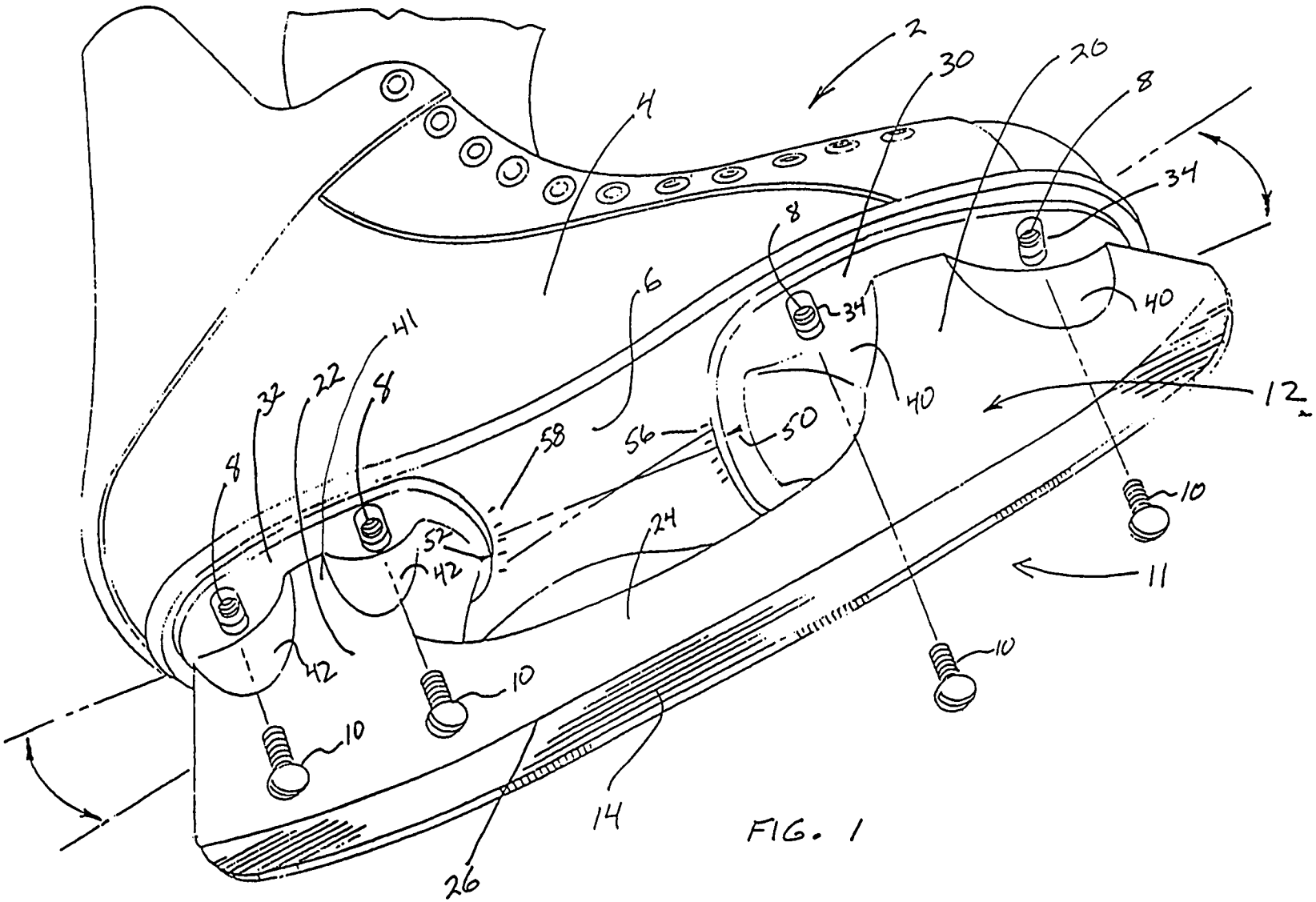
FIG. 1 is a perspective view of the blade holder with a series of elongated securing slots.
Figure 2:
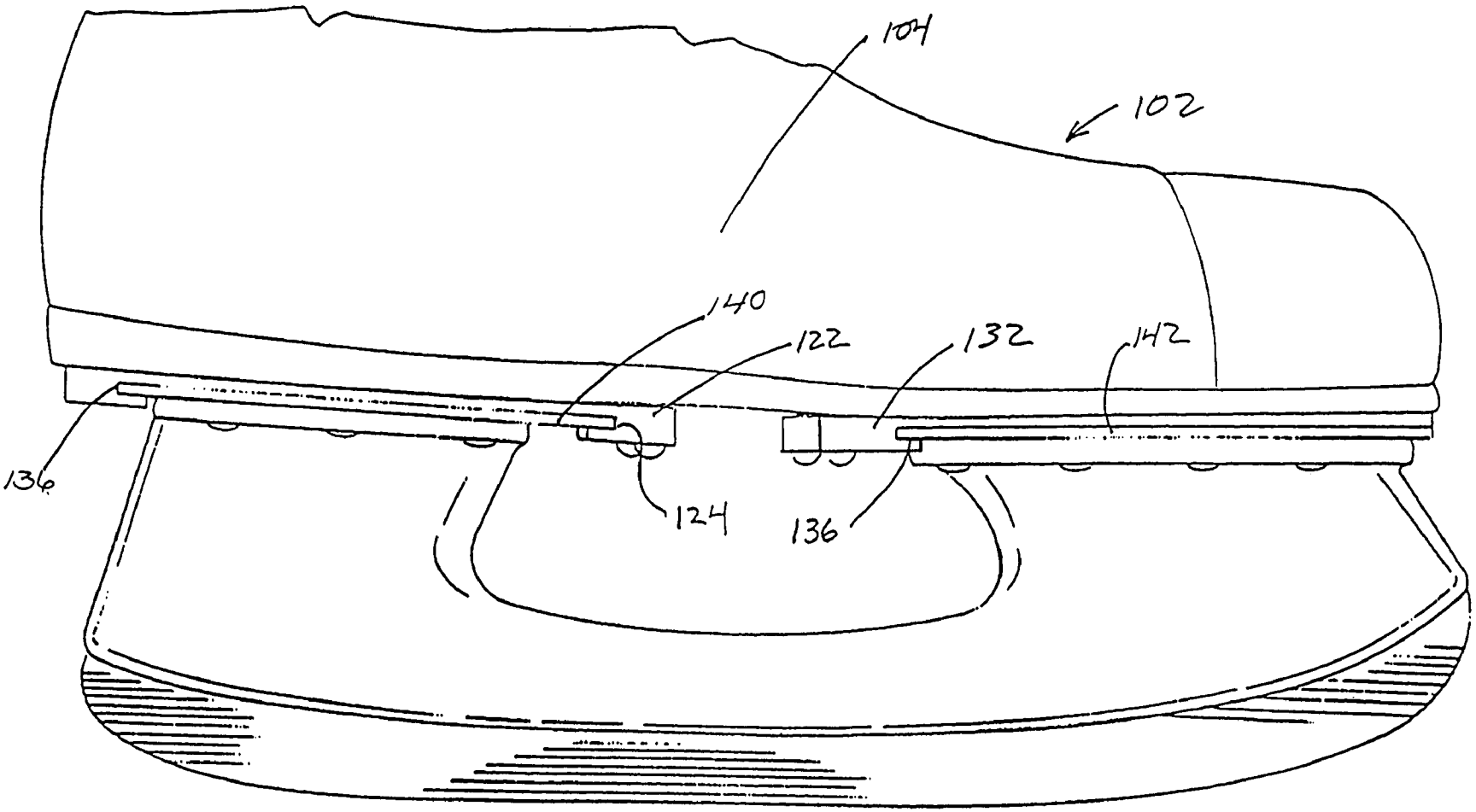
FIG. 2 is a side view of an adjustable plate system for the blade holder.
Figure 3:
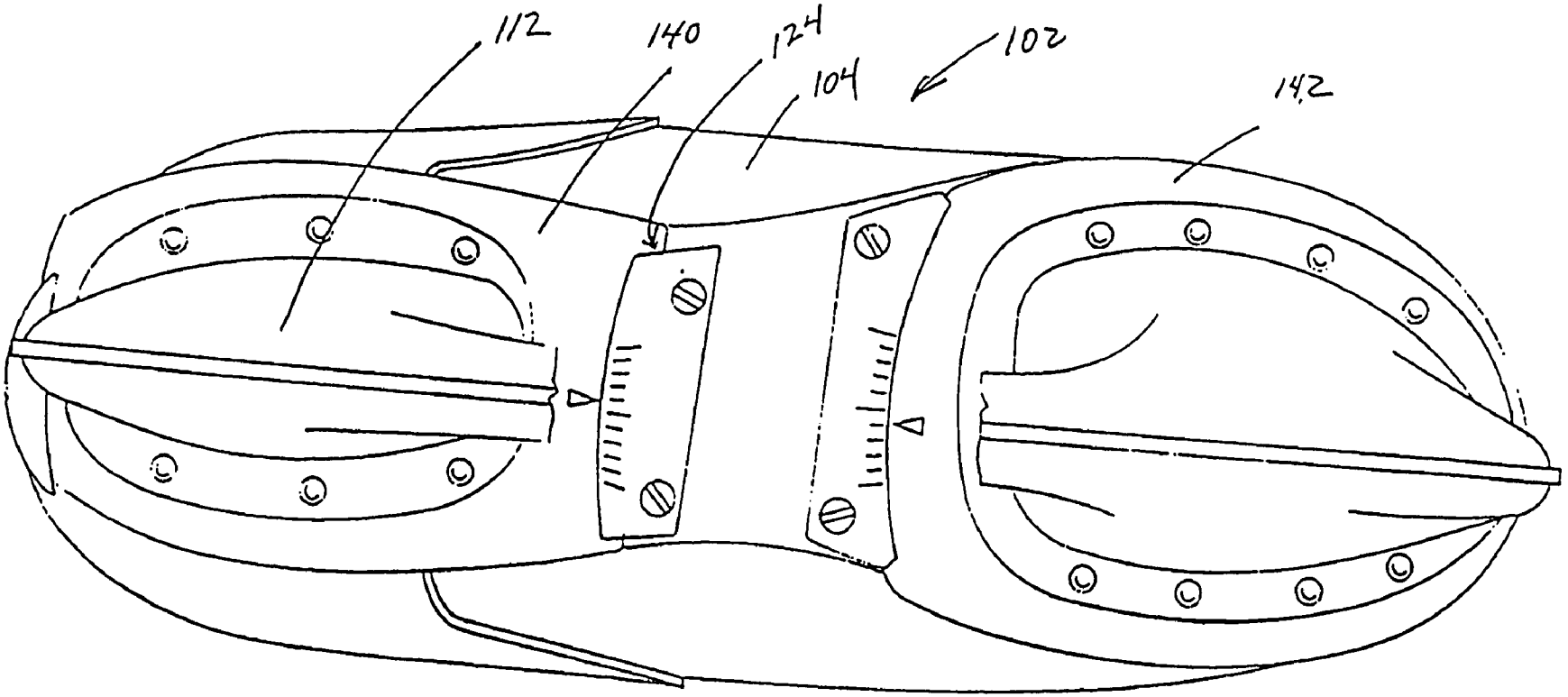
FIG. 3 is a bottom view of the blade holder of FIG. 2 showing the securing plates associated with the front and rear pedestals.
Figure 4:
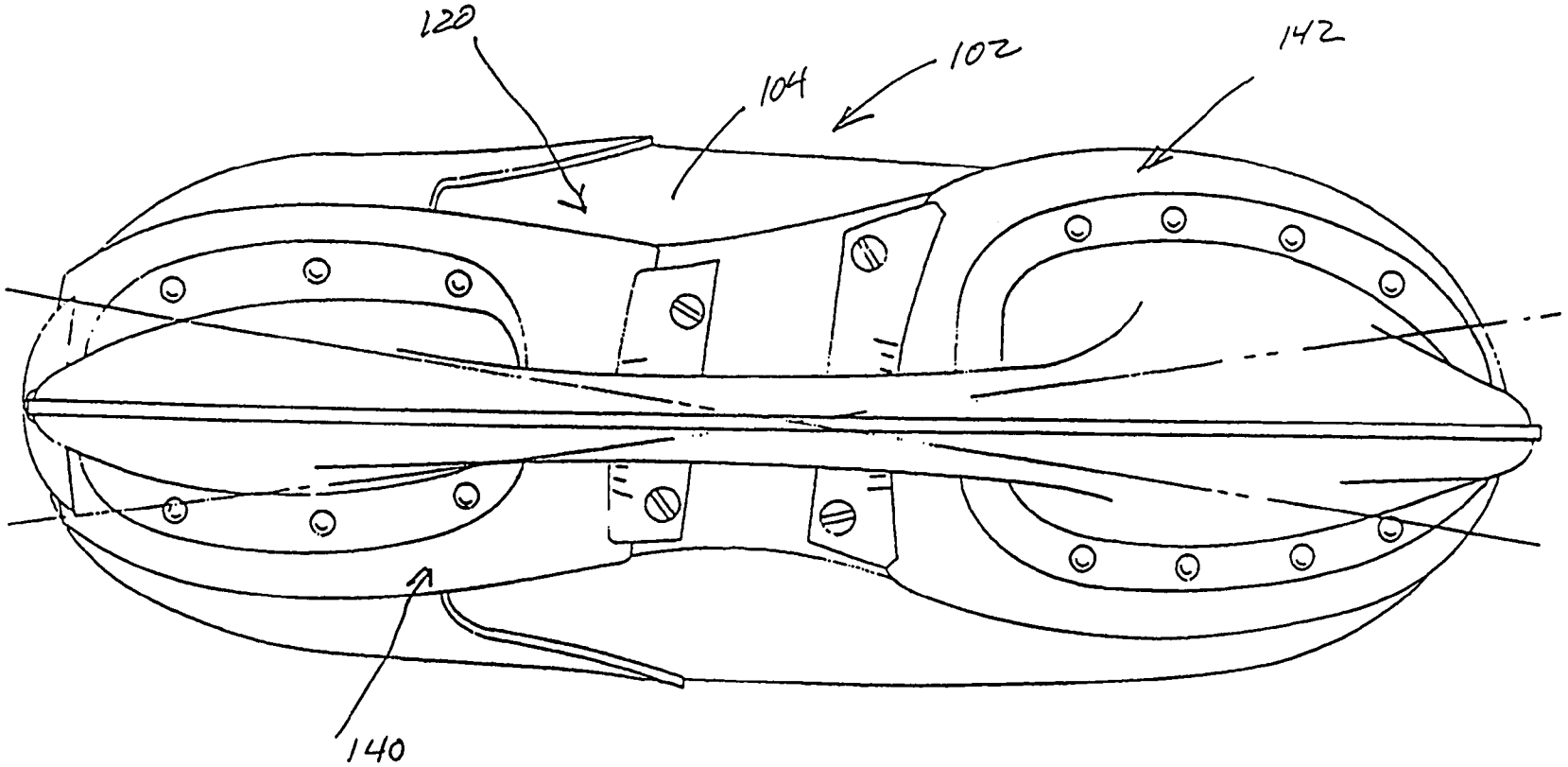
FIG. 4 is a bottom view showing adjustment of the plate system.
Figure 5:
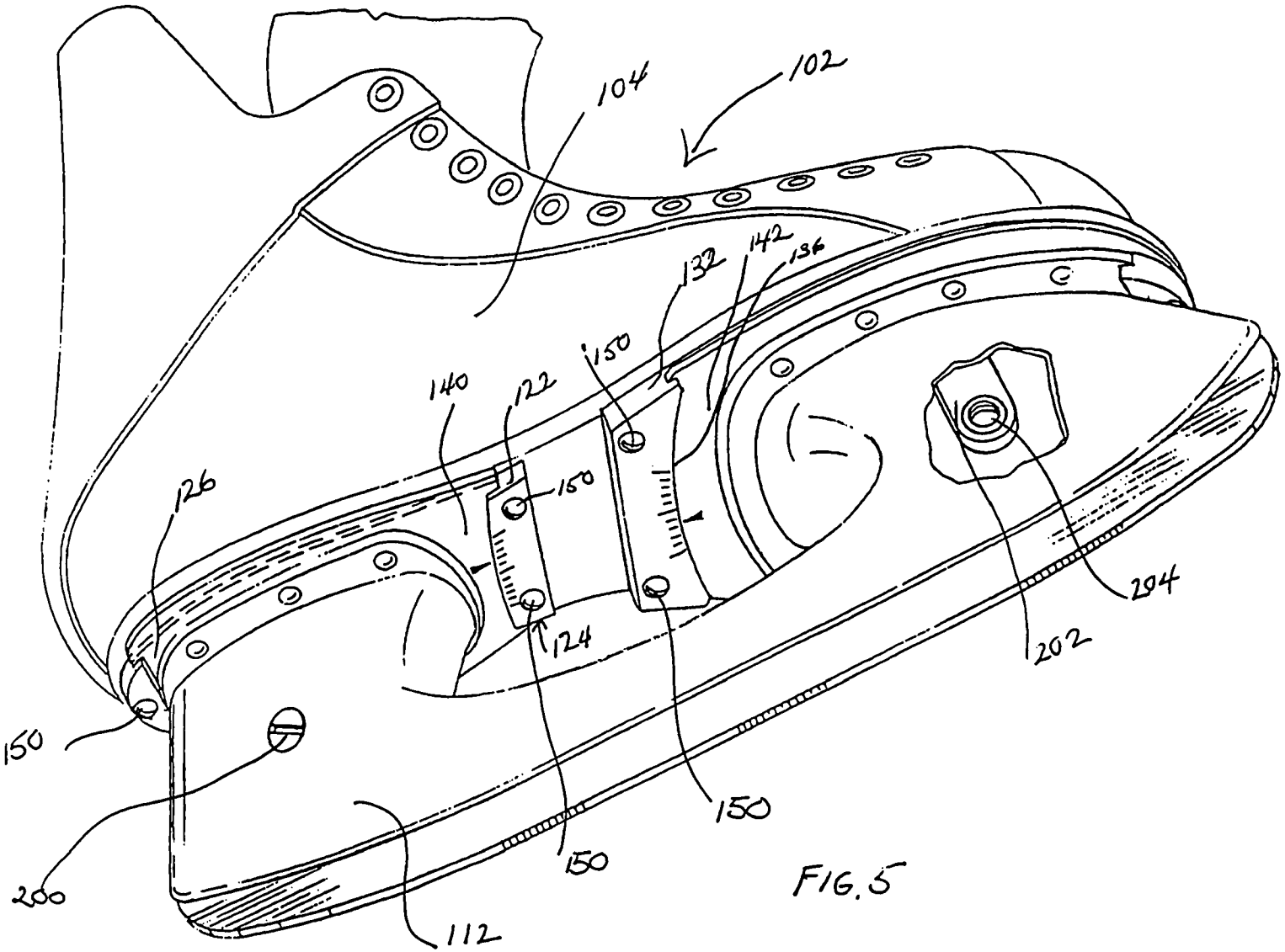
FIG. 5 is a perspective view of the adjustable plate system secured to the sole of a hockey skate boot.

The hockey skate 2 has a boot 4 with a stiff lower surface 6. The stiff lower surface 6 forms the sole of the boot and has a series of ports 8 for receiving releasable fasteners 10. The fasteners 10 can be two piece fasteners which extend through the sole of the boot or can be built into the boot. Thus, any suitable fastener can be used. The blade assembly 11 includes a blade holder 12 and a blade 14. Securement of the blade 14 to the holder can use any of the conventional arrangements or other securing system.

The blade holder 12 includes a front pedestal 20 secured under the toe of the boot and a rear pedestal 22 secured under the heel of the boot. The front pedestal and rear pedestal are joined by a connecting portion 24 which has the downwardly opening blade receiving slot 26 that partially receives the blade 14 along the length thereof. The blade is typically secured to the holder by a securement arrangement provided within the pedestals of the holder.

The front pedestal 20 includes an outwardly extending securing flange 30 and the rear pedestal 22 includes an outwardly extending securing flange 32. Relative to the conventional blade holder the flanges 30 and 32 are somewhat larger to accommodate the front elongate securing slots 34 either side of the holder and rear elongate securing slots 36 either side of the holder. With the larger flanges, the shape of the pedestals has been altered to include concaved recesses 40 in the front pedestal and concave recesses 42 in the rear pedestal. It is also possible to reduce the width of the pedestals and increase the flange area to accommodate the additional slot area or to make the pedestals closer to a post system. It is preferred to maintain the angled pedestal shape and use the concave recess to accommodate the slots.

These slots are positioned either side of the centerline of the blade holder and are used to secure the holder to the skate boot in a peripheral edge region of the boot on opposite sides of a centerline of the boot.

The concave recesses 42 are either side of the outwardly extending center section 41 that provides stability and strength and also provides an area interior to the pedestal for security of the blade.

With the system as shown in FIG. 1 the modified blade holder 12 can be secured to the sole of the boot in a plurality of positions. It is held in any of these positions by means of releasable fasteners 10 which engage the elongate slots and secure the holder to the boot.

If angular adjustment of the blade is necessary the releasable fasteners may be loosened and the blade holder repositioned relative to the sole of the boot. To assist in this realignment the flange 30 includes front and rear aligning marking 50 and the rear flange 32 includes aligning mark 52. The sole of the boot includes a number of aligning grooves 56 adjacent the toe portion and aligning grooves 58 in the heel portion to allow determination of the orientation of the blade 14 relative to the centerline of the boot or any reference point on the boot. Aligning marks can also be provided at the toe of the boot, if desired. The elongate slots are about ⅜ of an inch in length. The concave recess provides a flange area of about ⅝ of an inch.

With the system as shown in FIG. 1 the modified holder 12 can be releasably secured to the sole of the boot 4 and the user may provide adjustments of the position of the holder relative to the boot. In this case the various releasable fasteners are loosened and the skate holder 12 adjusted to a new orientation. The system allows for both toe in and toe out adjustment as well as heel in and heel out adjustments. The holder is also moveable relative to the centerline of the boot. All of these adjustments in combination, allow a player to find the position that provides him with the most comfort and performance. This arrangement can also be used with the skimming system shown in FIG. 16.

Once the desired position is known the holder can be permanently secured to the boot using rivets, screws, or other fasteners. The two-piece bolt and nut arrangement works satisfactorily and allows for adjustment or service, if necessary. Additional tight fitting securing holes in the securing flanges can be used or a conventional holder can then be mounted on the boot in the particular optimum position. The conventional holder can be modified to have the same marking points or to allow accurate placement. The actual blade holders are relatively inexpensive and it may be desirable to use the conventional style once the best position or satisfactory position has been determined.

The system of FIG. 1 allows for continuous adjustment within the slots but an incremented system can be used if desired. The system can accommodate forward and back adjustment if desired.

The arrangement shown in FIGS. 2 through 5 operates in a modified manner. In this case, the hockey skate 102 includes a boot 104 which receives or has integral with the base of the boot, an adjustable clamping arrangement 120. The clamping arrangement includes a heel mounting arrangement 122 which is fixed to the sole of the boot. This mounting arrangement includes a front clamping slot 124 and a rear clamping slot 126. The clamping slots provide a tight fit with the securing plates 140 and 142 but allow sliding movement along the slots. The modified holder 112 is attached to securing plates 140 and 142 to be generally fixed therewith. At the front of the skate 102 is a mounting plate 132 having a rear clamping slot 136. This member will receive the plate 142 such that the plate is slidable in the slots 136. Screws 150 can cause the slots 124, 126 and 136 to engage and fixedly retain members 140 and 142.

The modified holder 112 can also include a threaded worm drive associated with one or each pedestal. The threaded worm member cooperates with a threaded port fixed to the sole and thereby allows adjustment of the position of the holder relative to the rear member 122. The threaded port could be a rack gear attached to the sole. The gear adjustment can provide faster on ice adjustment.

With this system, the clamping slots can be released and the user can adjust the position of the heel relative to the centerline of the boot. In addition, the front pedestal of the holder can be adjusted relative to the toe of the boot.

In some cases rigid securement is not necessary. For example, a user can use several fasteners to secure the holder in place and test the skate in a cautious manner. Adjustments can quickly be made. Once the general desired position is known all fasteners can be used to test the skate under demanding conditions.

Each of the systems has a series of guide markings that allow the user to determine the position that the holder has been moved to. This can be quite important as adjustment of the front position typically causes some movement of the rear position. To find the optimum position a player may wish to keep notes on the different settings and the results at these settings.

The system of FIGS. 2 through 5 is designed to allow more rapid on ice adjustment of the position of the holder relative to the boot. Once it is generally known what positions are believed to be optimum the system can allow further fastening to test the skate under more demanding conditions. This system is designed to be used as part of the process for finding the optimum position or satisfactory position. Once this position is known it can be marked on the boot or the position can be determined by the various guide markings and then a conventional holder can be secured in that position to the sole of the boot with the skate being worn by the user. Each worm member is rotatably mounted with the holder and accessible at one side of the holder. The rotatable position of the worm member determines the position of the holder relative to the sole of the boot. The worm member 200 shown in FIG. 5 passes through a threaded port 304 in the downwardly extending post 202 attached to the sole of the boot. A worm drive member 200 is provided in each pedestal and posts 202 are attached adjacent each pedestal securing the blade holder sufficiently to allow testing and fast adjustment. The thread on the worm drive can be significantly aggressive to act as its own lock against further adjustment on a temporary basis. Preferably, the worm drives are adjustable from opposite sides of the boot holder and the threads are opposed to provide some binding or tensions therebetween. It is also possible to use a removable lock pin or other locking member for fixing the worm drive for skate trial basis. Once the final position is known, the holder is preferably fixed in a conventional manner or a conventional holder is substituted and secured in the desired position. The post 202 is only visible in FIG. 5 as the holder has been partially cut away.

Preferably, the worm drives are adjustable from opposite sides of the boot holder and the threads are opposed to provide some binding or tensioning therebetween.

It has been found that proper positioning of the blade holder can dramatically affect the ability of a hockey player to accelerate, turn in both directions and effectively perform at a higher level. It can also be appreciated that the player can select or effectively trade-off between positions that may allow more effective turning versus other positions which may allow for faster acceleration or ultimate speed. Most players will seek a compromise between these two characteristics. This system has been found to greatly improve the performance of hockey players whose particular physical attributes are significantly different from the norm. In addition, it allows player whose attributes are closer to the norm to fine tune the position to optimize or improve their performance.

Proper position of the holder to the boot sole can allow a player to skate more easily with less muscle effect to maintain balance and allow other muscles to be more relaxed. Thus, adjustment of the position of the holder allows muscles to be more efficient due to better alignment.

This system can also be used with different shims or modified holders to accommodate height adjustment or angle adjustment across the boot sole.

The modified skate 200 includes a skate boot 202 having a lace extension 204 provided at an upper position generally above the ankle and typically secured to an upper eyelet of the skate boot. The lace extension member 204 is of a "U" shaped formed molded plastic material and includes forwardly extending arms 206 and 208 provided either side of the skate boot. These extending arms act as spring arms and are typically secured to the skate boot by means of a rivet 214 or other securing mechanism securing the lace extension member to the skate boot. A series of holes can be provided in the extending arms 206 and 208 to allow proper alignment of the extension member with the skate boot such that it is generally adjacent the back of the skate boot. With this arrangement, the rear connecting band 216 can be immediately adjacent the skate boot.

Figures 6, 7:
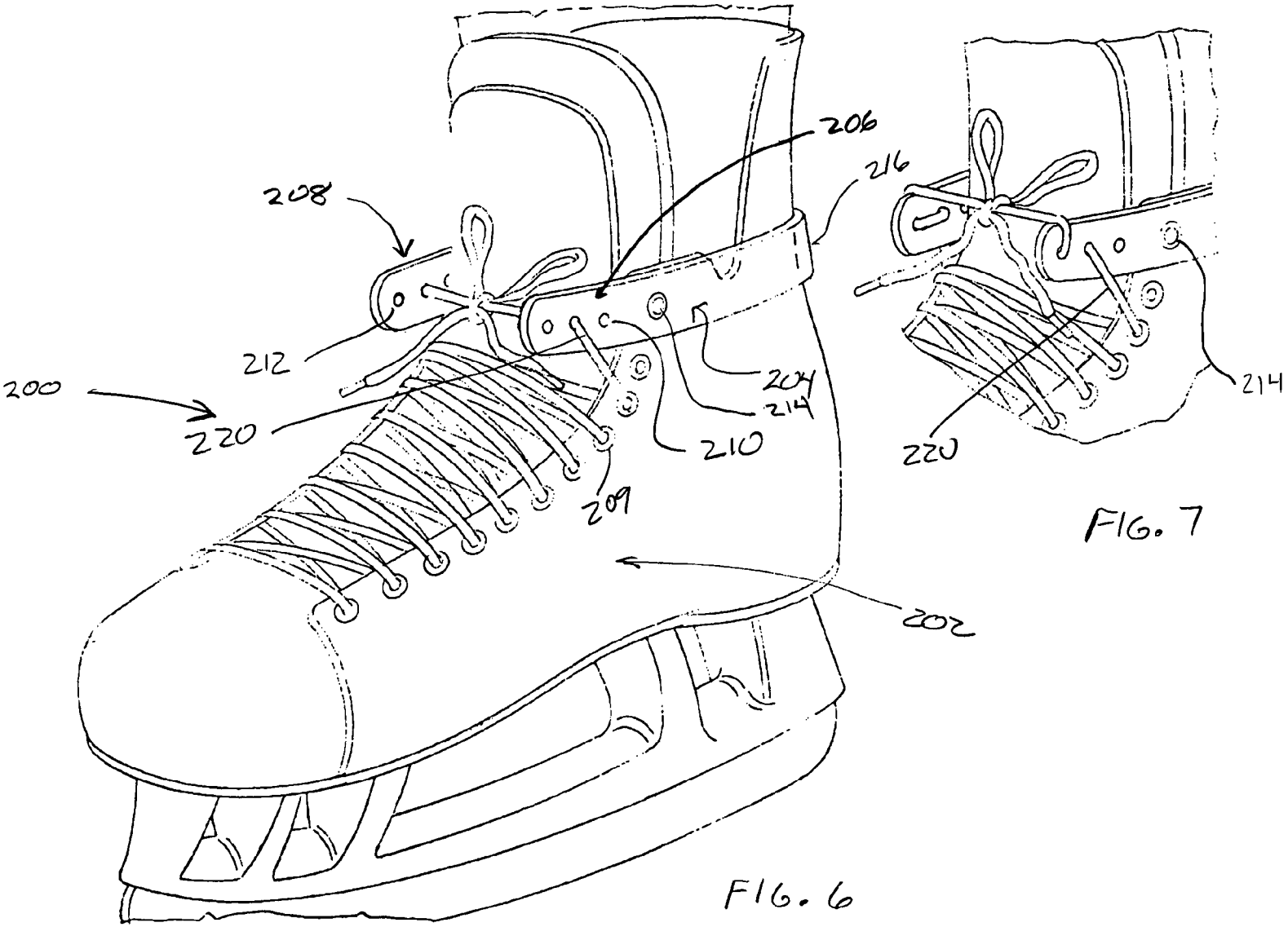
FIG. 6 is a partial perspective view of a skate with a lace extension member provided at an upper proportion thereof.
FIG. 7 is a partial perspective view showing details of the lace extension member.
Figure 8:
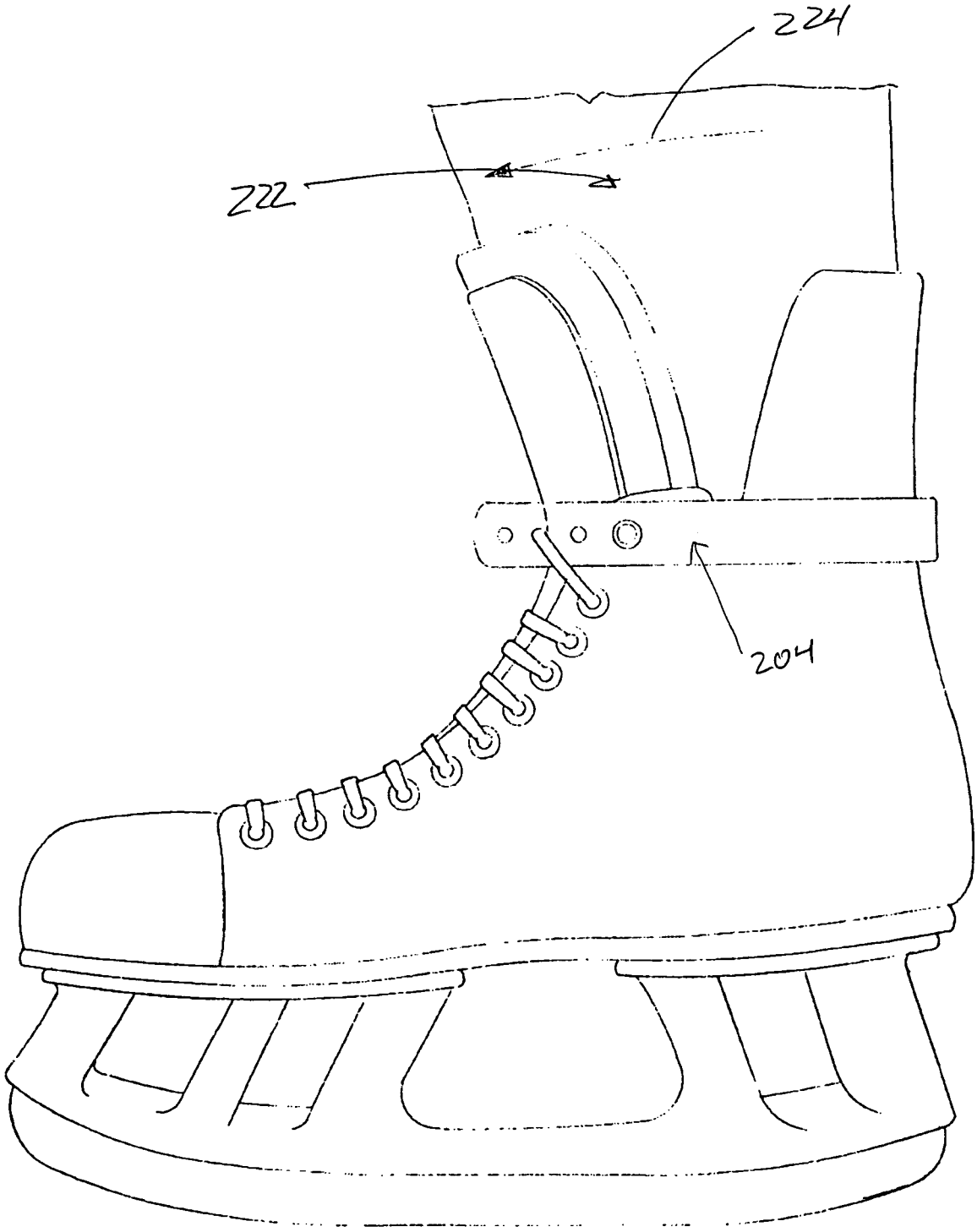
FIG. 8 is a side view of a skate with the lace extension member secured thereto.

As shown in FIG. 6, the lace 220 is used for securing and tightening of the lower portion of the skate boot 202 and adjacent an upper eyelet the lace then engages the forwardly extending arms 206 and 208. With this arrangement, a pivoting slot is defined at an upper portion of the skate that allows a user's leg to pivot about the ankle allowing movement in a forward and rearward direction. This provides support either side of the slot by means of the tightening on the extending arms 206 and 208 but does not require buckling or hinging of the skate boot as may otherwise be required. The forward and rearward pivoting slot that is defined by this arrangement is shown as 224. FIG. 8 illustrates how the user's leg 222 can generally pivot about the ankle bone and move within the slot defined by the lace extension member 204.

It has been previously recommended by some hockey and/or skating coach's not to fully lace a hockey skate and leave the top eyelets unused. This allows additional forward and rearward movement within the skate body. Unfortunately, by not using all of the eyelets, there is less support above the ankle and although there is improved movement forward and rearwardly, there is also an undesirable decrease in lateral support. The use of the lace extension member 204 provides excellent lateral stability while still allowing the forward and rearward pivoting movement indicated by 224.

The lace extension member 204 is secured to the skate boot 202 typically using the eyelets 209 of the skate boot where these eyelets are positioned at the upper portion of the skate boot. Other securement approaches, such as further holes made for the extension member, can also be used.

In FIG. 6 a rivet 214 secures the lace extension member 204 to the skate boot to the exterior of the skate boot. Various different lacing arrangements can be provided as shown in FIGS. 6 and 7. In FIG. 6 the lace 220 passes through a single port in each of the arms 206 and 208 and is tied at a center position. This allows some floating of the arms while the arms are still restricted by a tensioning force provided by the lace 220. The extension member may also be cut to the appropriate length, thereby reducing when necessary, the length of the extension arms.

In FIG. 7, the lace 220 passes through two of the eyelets 212 provided in the lace extension member and the lace provides secure positioning of the extending arms 206 and 208 relative to one another and defining the slot therebetween. This arrangement provides additional lateral stability and provides some additional resistance as the user's leg is moved to the most forward portion within the slot. The user can select the most appropriate securing arrangement for his particular preference. It is also noted that the present skate shows a single securing arrangement used where the skate lace 220 initially secures the lower portion of the boot and then is used to secure the lace extension member. Separate lacing arrangements can be used if desired.

Figure 9:
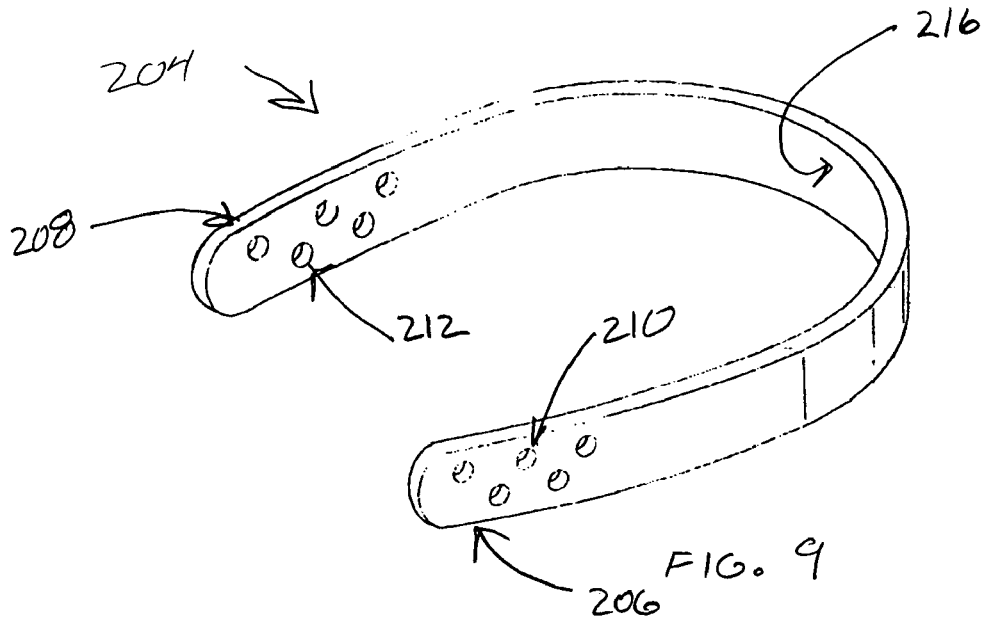
FIG. 9 is a perspective view of the lace extension member.
Figure 10:
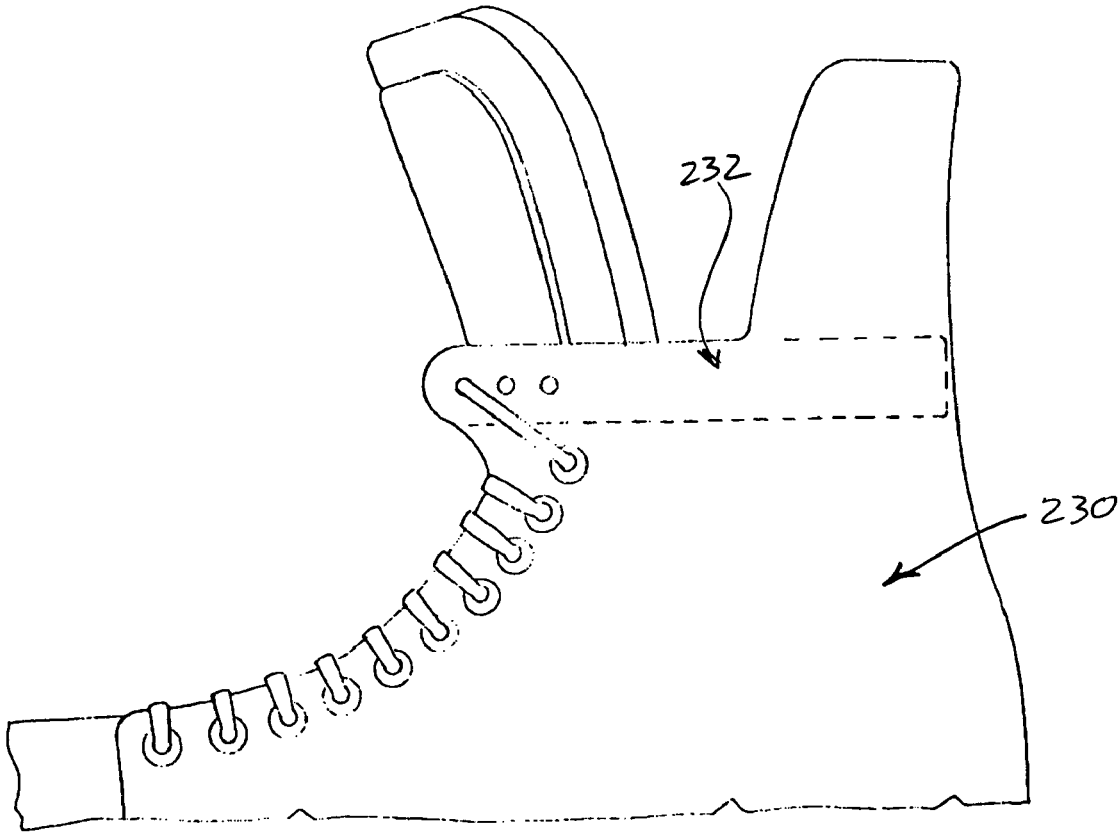
FIG. 10 is a partial side view of a skate with the lace extension member built into the boot of the skate.
Figure 11:
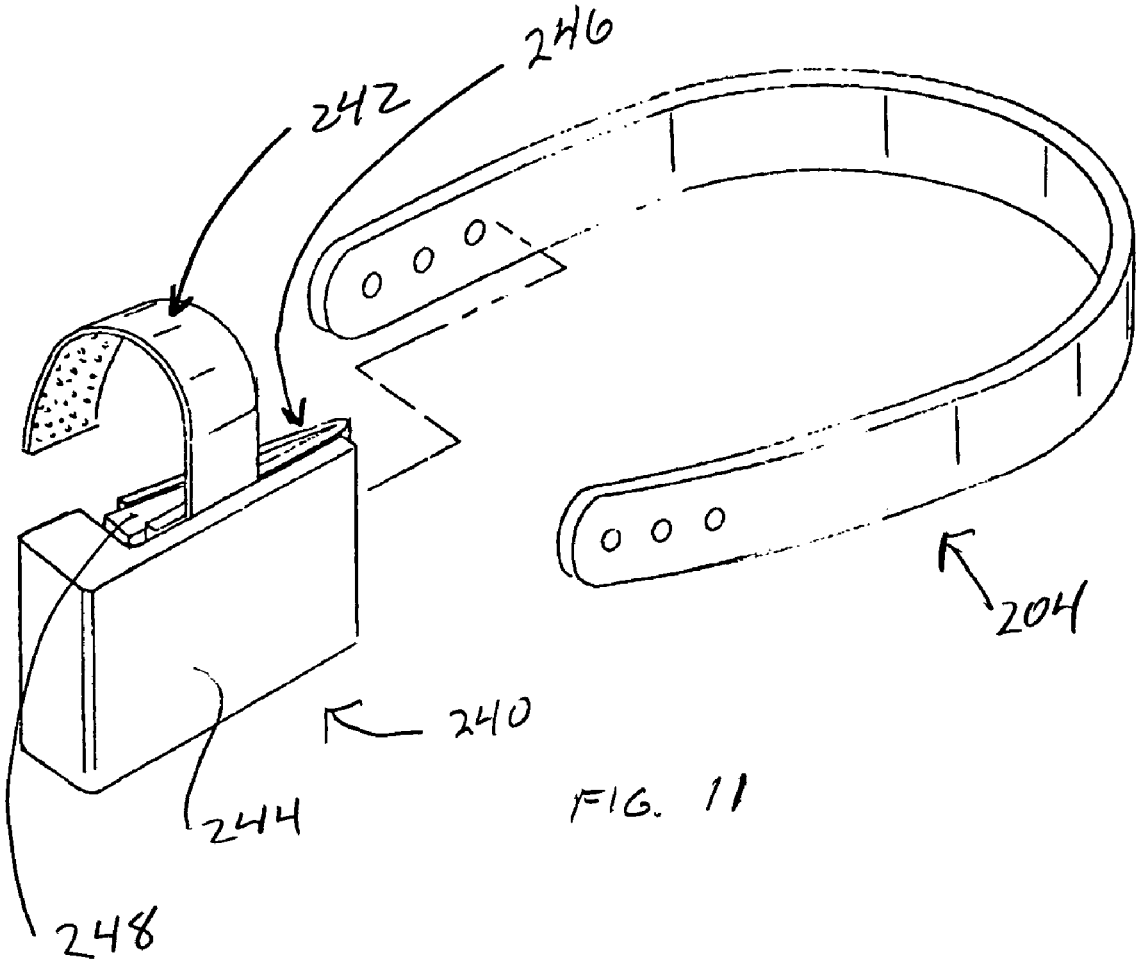
FIG. 11 shows the lace extension member in combination with packing material for securement to one side thereof.
Figure 12:
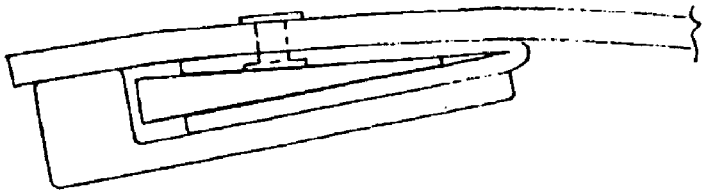
FIG. 12 shows the lace extension member and packing material secured to the lace extension member.

It can also be seen in FIGS. 8, 9 and 10 that the different eyelets 210 and 212 provided in the extending arms 206 and 208, allow the user to modify the securement of the lace extension member in a desired manner. These forwardly extending arms are not only secured to the skate boot but are also connected by the rear connecting band 216. In this way, the force between the two arms is partially balanced by a resistance force of the lace extension member to the inward movement of the lace extending arms.

In FIG. 10 the modified skate 230 is shown where the lace extending member 232 is built into the boot skate. It is desirable to have the lace extension member integral such that each of the arms are connected and jointly oppose inward movement of the arms thereby maintaining the slot like area at the upper portion of the skate to allow forward and rearward rocking movement of the skater. It is desirable in a skating action to allow this ability to adjust the center of gravity by changing the angle of the leg relative to the skate boot.

With hockey skates, and in particular, playing hockey, it is important that the skate blade be generally perpendicular to the ice surface when the player is in a normal position. It is also desirable that the blade be approximately aligned with the forward direction. The skate is inclined during turning and it is important to be able to turn in both directions. The neutral perpendicular position is desire. Furthermore, the skate blade should be generally parallel to the skate blade of the other skate in this neutral position. Playing hockey involves skating in both the forward and rearward direction and this neutral position of the blade is a preferred starting point. Furthermore, there are various times in hockey when the player is gliding. This is particularly true when preparing to shoot. There is a large weight transfer over the skate and the position of the player's body over the skate changes. An unfavourable angle of the skate blade can reduce the time that the player has to complete a shot and the angle of the blade may define a travel direction which makes the shot more difficult to complete.

Unfortunately, the neutral position of the skate blade is not easily achieved. As shown in the earlier drawings, the skate blade holder can be provided with slots to provide better alignment of the skate blade beneath the skate boot.

FIGS. 11 through 14 shows the use of a packing material 240 secured to the lace extension member 204 allows shimming adjacent the cuff of the hockey skate. The effect of this shimming is shown in FIG. 15. It is desirable to have the blade 251 of the skate approximately perpendicular to the ice in a neutral player position. It is also desirable to have this blade 251 generally centered beneath a user's knee.

FIG. 15 illustrates how the packing 240 can be used to partially correct an outward bowing of the player's leg in combination with a shim arrangement 270. The packing provided at the cuff of the hockey skate allows for some correction and the shims 270 provide additional correction. The combination of these correction factors and adjustment of the blade position as shown in the earlier drawings is helpful to approach or reach this neutral position.

Figure 16:
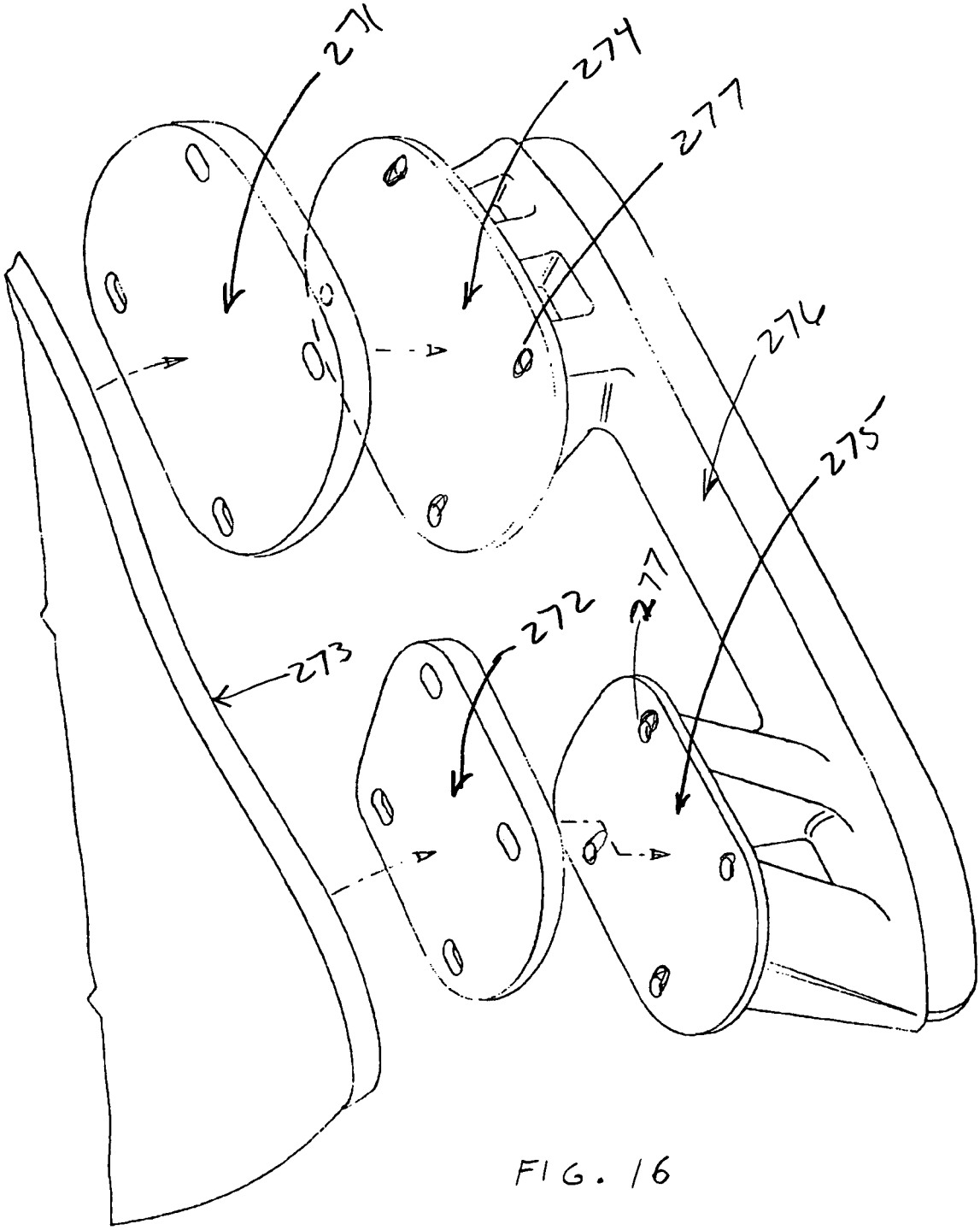
FIG. 16 is a partial perspective view showing shimmy members secured between the skate boot and a skate blade.
Figure 17:
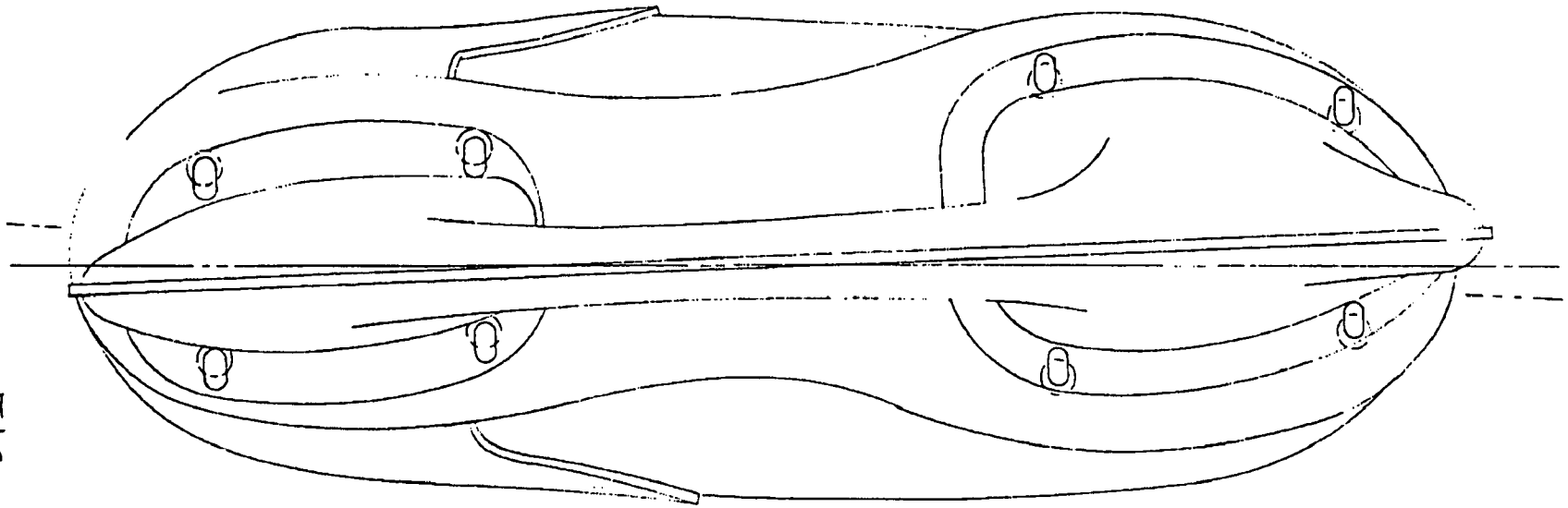
FIG. 17 shows the alignment of the skate blade holder to the skate boot.

FIG. 16 illustrates the shim members 271 and 272 interposed between the base 273 of the hockey skate and the mounting flanges 274 and 275 of the blade holder 276. Depending upon the amount of correction required according to the particular characteristics of the user, different shim members 271 and 272 may be used. The blade holder 276 includes the slots 277 to allow for alignment adjustment as indicated in FIG. 17. A series of different shims can be provided to select the appropriate shim. As these factors affect each other, several iterations may be necessary. There may also be some personal preferences about the "neutral position".

Figure 13:
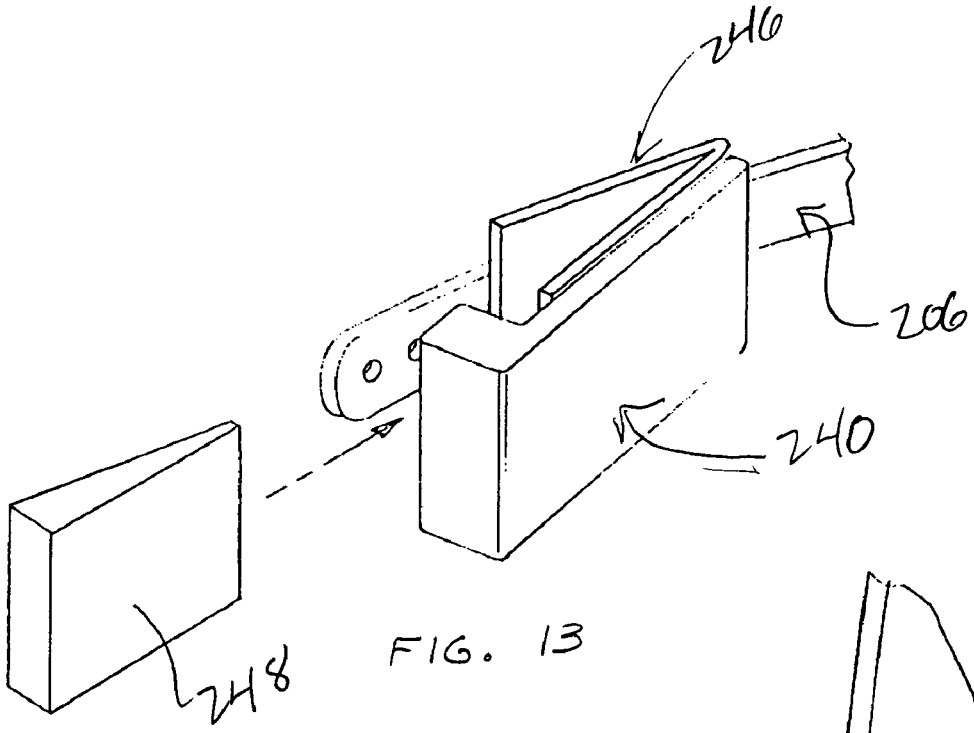
FIG. 13 is a partial perspective view showing how additional packing material may be added thereto.

FIG. 13 shows how a packing arrangement 240 is securable to one of the extending arms. In this case, arm 206, has packing 240 defined by a folded packing member 246 secured to the arm 206 with different wedge members 248 insertable within folded packing. The folded packing member 246 is "V" shaped and is preferably fixed to the appropriate extending arm 206.

Figure 14:
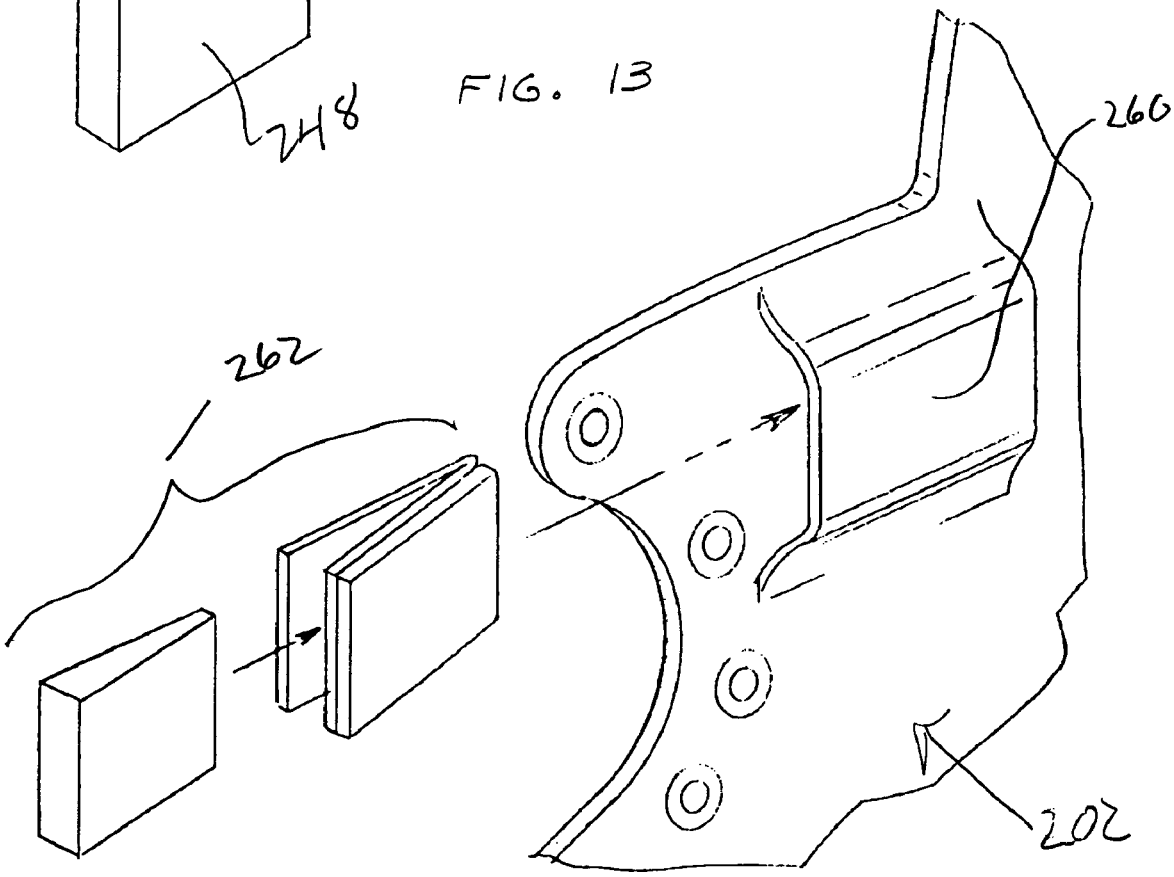
FIG. 14 is a partial perspective view showing a modified skate boot with a pocket for receiving packing material at an upper edge of the skate boot.
Figure 15:
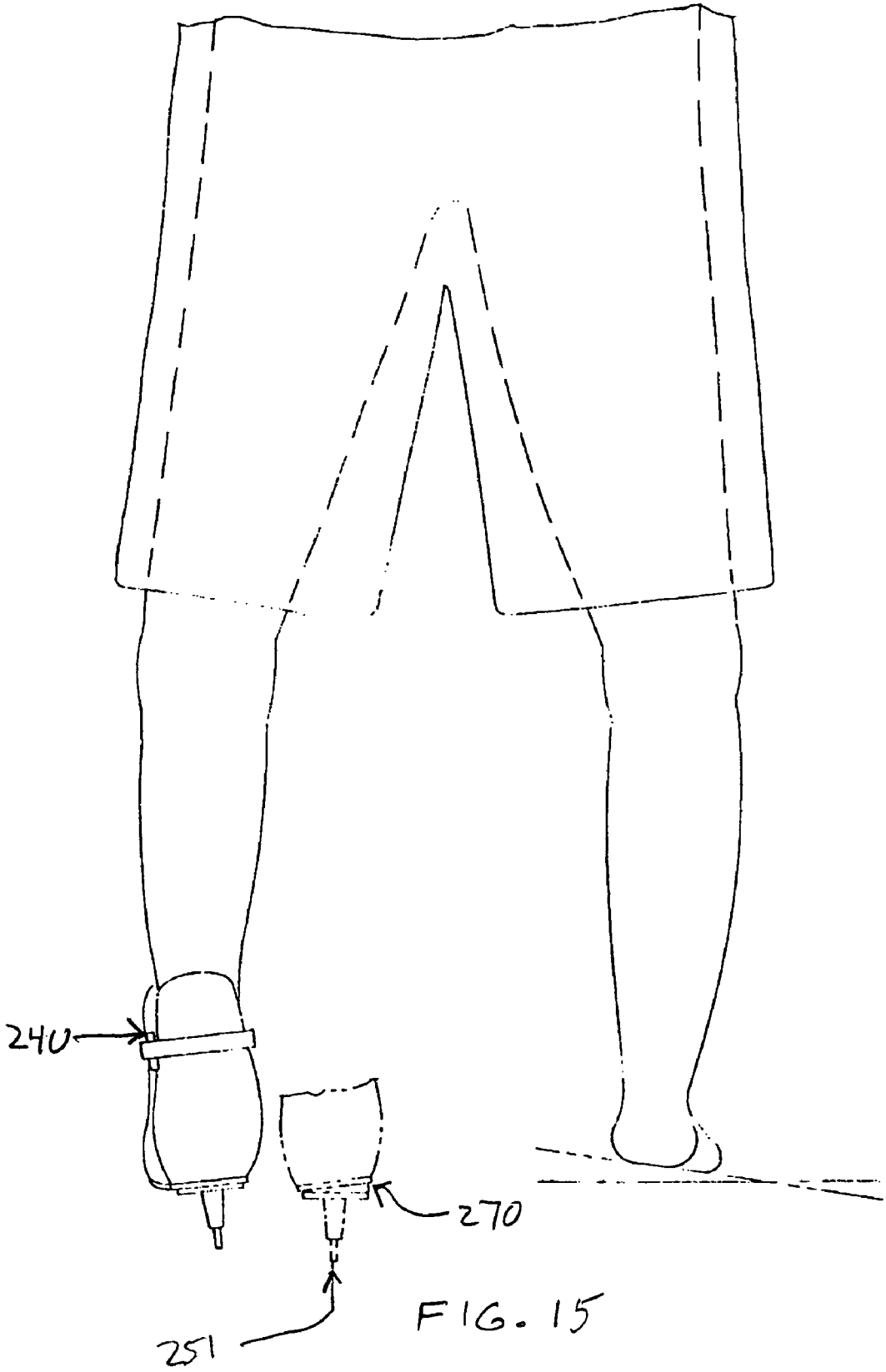
FIG. 15 is a rear view showing the legs of a skater and the correction necessary to provide a flat running skate blade.

In FIG. 14, the interior surface of the skate boot 202 has been provided with a packing/receiving sleeve 260. Once again, packing 262 can be received within the sleeve 260 for appropriate correction of the position of the skater's leg within the boot.

The lace extensions allow maximum or ideal knee positions relative to the skate boot. The knee can move forward of the front of the foot, without the blade coming off the ice. The lace extension is rigid enough to squeeze the sides of the boot to add stability where it is tightened at the front for maximum knee bend.

The padding system fills in selected areas above the ankle and creates a more comfortable and stable skate boot. The padding system reduces side to side wobble adjacent and above the protruding ankle. The padding system can provide more padding to one side of the boot than the other side. This changes the angle of the foot bed helping skaters whose feet currently roll inward or outward. This padding system when used in conjunction with the blade system that can be shimmed, allows the blade to ride flat on the ice.

The blade holder that is easily shimmed from the outer edge and includes elongated slots, allows for a correct alignment of the blade. This alignment allows better balance the skater over their blade and or a straight path of travel of the blade for easier striding and gliding.

A combination of all of these features help to bring the knees over the centerline of the foot and over the balance point of the knee bend. All of the corrections make it easier on many of the direct use muscles and counter balance muscles required in skating. It also provides a more direct transfer of the power to the blade, which increases speed. This increase in speed is realized by:

1. taking out the time it takes for good contact to be achieved when the skate boot rolls over;

2. by having the knee directly over the foot you reducing the time it takes to overcompensate for balance, as the knee doesn't have to move as far from inside to outside when changing direction or turning; and 3. by bending over more you lengthen the stride and utilize more of the larger quadriceps and glute muscles. As well the hamstring is more prevalent in the stride, reducing the demand on each muscle and spreading it over them all you have more power for longer periods of time.

With the above arrangement, a series of corrective steps can be carried out to provide an effective skate for a particular skater adjusted to the skater's physical characteristics. This correction is accomplished in a series of adjustment in contrast to the use of an orthopaedic foot bed for example, which would be common in running shoes and other sports. Unfortunately, a corrective foot bed is not entirely effective as it can not be used with many existing hockey skates as the volume within the skate boot is not sufficient. Furthermore, unfortunately the shape of the boot would still be incorrect even though the bottom of the user's foot is properly orientated. In many sports, lateral stability is not particularly critical whereas in hockey, this is indeed a critical function, as well as the resulting position of the skater's leg or knee relative to the skate boot.

The present system provides an effective arrangement to allow a user to adjust a hockey skate according to their particular physical attributes and to also adjust the skate to their particular preference. The ability to provide packing above a user's ankle in combination with shimming and an alignment mechanism for the blade of the hockey skate is particularly effective. Once the desired position has been found, the blade can be securely fastened in a manner suitable for hockey. This may include riveting or otherwise fixing of the blade in its final position. It has been found that the mechanical fasteners previously used, are satisfactory if there are sufficient fastening positions provided outwardly of the skate blade in the flange areas. Peripheral securement either side of the centerline is necessary for effective securement of the blade in a hockey skate. It is not appropriate to use center securement and the center securement would be particularly inappropriate if shimming is provided.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A hockey skate comprising a boot, a blade holder secured to said boot, and a blade received in said blade holder, said boot including two opposed series of eyelets receiving a lace for securing of said boot to a user's foot with a lace extension member secured to an upper portion of the boot; said lace extension member including two extending arms located on opposite sides of said boot adjacent a top edge thereof and project forwardly of upper eyelets of said series of eyelets; said lace passing through eyelets in said extending arms to draw said arms towards one another and define an enlarged slot at a top opening of said boot extending forwardly of said upper eyelets and being oversized relative to a user's leg for accommodating pivoting movement of the user's leg in a forward/rearward direction relative to the boot.

2. A hockey skate as claimed in claim 1 wherein said blade holder is secured to said boot with an adjustable arrangement comprising a series of releasable fasteners passing through slot shaped ports in said blade holder and engaging said boot to secure said holder to said boot.

3. A hockey skate as claimed in claim 1 wherein each of said opposed series of eyelets from a toe portion of said skate to an upper portion of said boot are positioned to define an arc pattern with each successive eyelet being located closer to a rear upright portion of said boot and wherein said eyelets of said forwardly extending arms are forwardly offset relative to at least said adjacent upper eyelet of said series of eyelets.

4. A hockey skate as claimed in claim 1 wherein said lace extension member is of a resilient plastic material and of a 'U' shape fixedly secured to opposed sides and a rear surface of said boot with said forwardly extending arms forming sides of said 'U' shape.

5. A hockey skate as claimed in claim 4 wherein said lace extension member is mechanically secured to said boot adjacent upper eyelets.

6. A hockey skate as claimed in claim 1 including removable padding material secured to said boot on an interior side surface thereof at a position above art ankle receiving portion of said boot.

7. A hockey skate as claimed in claim 6 wherein said removable padding material is received in a pocket of said boot.

8. A hockey skate as claimed in claim 7 wherein said pocket is open in a forward direction of said skate.

9. A hockey skate as claimed in claim 8 wherein said removable padding material is wedge shaped.

10. A hockey skate as claimed in claim 8 wherein said lace extension member is an integral component of said boot and is fixedly secured to said boot.

11. A hockey skate as claimed in claim 10 wherein each forwardly extending arm includes a plurality of lace eyelets allowing a user to select appropriate eyelets for customizing the fit with all of said plurality of lace eyelets positioned forwardly of said upper eyelets of said series of eyelets thereby allowing variation of a length of said enlarged slot forwardly of said upper eyelets.

12. A hockey skate as claimed in claim 10 wherein said lace extension member is generally parallel to a bottom surface of said boot.

13. A hockey skate as claimed in claim 12 wherein said blade holder is adjustably secured to said boot.

14. A hockey skate as claimed in claim 13 wherein said blade holder includes wedge members for angling of said blade holder relative to a bottom surface of said boot.

15. A hockey skate as claimed in claim 13 wherein said blade holder is adjustable to vary the position of a longitudinal axis of said blade holder relative to a longitudinal axis of said boot.

* * * * *